US005508784A

United States Patent [19]

Matsuoka et al.

[11] Patent Number: 5,508,784

[45] Date of Patent: Apr. 16, 1996

[54] SPEED CONTROL FOR COLOR IMAGE FORMING APPARATUS WITH RESIDUAL TONER CLEANING

[75] Inventors: Isao Matsuoka; Hajime Osaki, both of Tokyo, Japan

[73] Assignee: Konica Corporation, Tokyo, Japan

[21] Appl. No.: 409,609

[22] Filed: Mar. 24, 1995

[30] Foreign Application Priority Data

Apr. 5, 1994 [JP] Japan ..... 6-067345

[51] Int. Cl.[6] ..... G03G 21/00

[52] U.S. Cl. ..... 355/200; 355/296

[58] Field of Search ..... 355/299, 200, 355/296, 326 R; 318/685; 388/804, 811, 812, 930, 805, 819

[56] References Cited

U.S. PATENT DOCUMENTS

| | | | |
|---|---|---|---|
| 5,111,242 | 5/1992 | Tanimoto et al. | 355/200 |
| 5,115,280 | 5/1992 | Hamada et al. | 355/299 |
| 5,412,302 | 5/1995 | Kido et al. | 318/685 |
| 5,444,525 | 8/1995 | Takahashi et al. | 355/327 |

FOREIGN PATENT DOCUMENTS

| | | |
|---|---|---|
| 59-15221 | 1/1984 | Japan . |
| 5-40398 | 2/1993 | Japan . |

*Primary Examiner*—Joan H. Pendegrass
*Assistant Examiner*—Quana Grainger
*Attorney, Agent, or Firm*—Finnegan, Henderson, Farabow, Garrett & Dunner

[57] ABSTRACT

A color image forming apparatus includes a driving member to drive a rotational photoreceptor to rotate, a speed detector to detect speed information of the photoreceptor, and a mechanism in which a pressure-contact and pressure-contact release operations of a cleaning member are carried out on the photoreceptor. The apparatus further includes a drive controller by which the rotation speed of the photoreceptor is controlled according to a signal output from the speed detector so that the rotational speed of the photoreceptor remains equal to a predetermined value.

9 Claims, 7 Drawing Sheets

WAVEFORM OF PULSES OUTPUTTED FROM THE ENCODER

WAVEFORM OF 1/8 FREQUENCY-DEMULTIPLIED PULSES

PULSE COUNTING

CONVERSION OF THE SPEED INTO THE NUMERICAL VALUE

AVERAGING

SPEED CONTROL FOR COLOR IMAGE FORMING APPARATUS WITH RESIDUAL TONER CLEANING

BACKGROUND OF THE INVENTION

The present invention relates to a color image forming apparatus for use in a copier, printer, printing apparatus, etc., to which an electrophotographic method, an electrostatic printing method, or the like, is applied. Specifically, the present invention relates to a digital type color image forming apparatus such as a digital type color copier, a color printer, etc., for which a highly accurate writing means using a laser beam, or the like, is required.

Generally, in a digital type color image forming apparatus using a transfer type electrophotographic method, a rotary drum type photoreceptor, around which a photoconductive photoreceptor layer is provided, is used. In the apparatus, optical scanning is conducted on the surface of the above-described photoreceptor layer by laser beams so that an electrostatic latent image is formed, and the latent image is developed into an image by toners, while the photoreceptor is being rotated. Further, in the apparatus, the toner image thus obtained is transferred onto a recording sheet. On the peripheral surface of the photoreceptor, from which the image has been transferred onto the recording sheet, residual toners which adhered onto the surface are separated and cleaned from the surface by a cleaning member, and the electrostatic latent image is formed again. Then, in the apparatus, a new image is transferred onto a recording sheet.

Specifically, in an color image forming apparatus in which a multi-color image is formed by composition of monochrome images, a plurality of developing units, in which color toners are respectively accommodated, are arranged around the photoreceptor. A latent image corresponding to each color, formed for each rotation of the photoreceptor, is noncontact-developed into a toner image, and a multi-color toner image is formed when the photoreceptor is rotated plural times. This multi-color toner image is transferred onto a recording sheet. After that, in the same way as the general image forming apparatus, the residual toner on the photoreceptor surface is separated from the surface and removed by the cleaning member. The cleaning operation is carried out when the cleaning member, composed of a blade member, or the like, comes into pressure-contact (or contact) with the image forming surface of the photoreceptor. This operation, therefore, can not be carried out during toner image formation, or before the transfer operation. Accordingly, the cleaning member is held at a position separated from the photoreceptor surface during the above-described operations. A cleaning mechanism is structured in such a manner that pressure-contact of the blade member is started just before the leading edge of the transferred toner image comes to the cleaning position, and the pressure-contact is released just after the trailing edge of the toner image has passed.

As the cleaning member which is controlled in such a manner that the cleaning member comes into pressure-contact with and is released from the photoreceptor surface in the relationship with the image forming process, there is, for example, a blade cleaning method. In this method, toner which adhered onto the peripheral surface of the photoreceptor is forcibly separated from the surface by the edge of the blade member which comes into pressure-contact with the peripheral surface of the photoreceptor.

In the cleaning apparatus using such the blade method, a multi-color toner image, which has not yet been completely formed, passes a position opposed to the cleaning apparatus, when a multi-color toner image is formed on the photoreceptor. Accordingly, the blade is separated from the photoreceptor surface, and after the multi-color toner image has been completely formed and transferred, the blade comes into pressure-contact with the photoreceptor surface and removes any residual toner.

When the blade comes into pressure-contact with and is released from the photoreceptor surface, the photoreceptor receives a load against its rotation, causing variation of the rotational torque and nonuniform rotational speed. The following are other image forming processes which become the factors of load fluctuation causing the nonuniform rotational speed of the photoreceptor drum.

(1) Pressure-contact or release of the transfer apparatus such as the transfer belt and transfer roller.

(2) Start and stoppage of the drive of the developing unit.

(3) Pressure-contact or release of the process unit, in which the developing unit, the transfer apparatus and the cleaning apparatus are integrally included.

This nonuniform rotation of the photoreceptor causes registration failure of the multi-color images and prevents sharp multi-color image formation. More specifically, when the photoreceptor causes the nonuniform rotation, nonuniform distance is caused between subsidiary scanning lines, resulting in the distance between writing lines in the subsidiary scanning direction becoming larger and/or smaller. As a result, in the image quality, density variation phenomenon of the image density, which is called an uneven image pitch or jittering, is caused, resulting in lowering of the image quality. Recently, this phenomenon is greatly emphasized as requirements of higher image quality in the market becomes greater. This phenomenon has become a large problem as the writing density of the image is increased, or as the accuracy of reproducibility of the development is increased when small diameter toners of 5.0 through 9.0 μm, the diameter of which is smaller than that of conventional toners, are adopted in the apparatus.

Accordingly, it is a major problem to quickly control the speed variation due to the load, and to form an electrostatic latent image by an image writing means by highly accurate optical scanning, and by a highly accurate position control of the scanned surface.

Conventionally, in view of such problems, a large sized and heavy weighted flywheel is attached to the photoreceptor so that more uniform rotation can be maintained. On the other hand, conventionally, improvement of the optical scanning apparatus, in which the nonuniform distance between scanning lines (uneven pitch) in the subsidiary scanning direction is compensated for when optical beams scan the photoreceptor surface, has been proposed, for example, in Japanese Patent Publication Open to Public Inspection Nos. 15221/1984, and 40398/1993. Due to the contents of both patent publications, the speed of the scanned surface is detected, and the nonuniform distance between scanning lines is prevented when the optical scanning position of optical beams is changed, in cases where the speed variation occurs.

However, in the case where a flywheel is used, a relatively large mass is necessary to obtain sufficient rotational stability. When the flywheel is attached to the photoreceptor, the weight of the apparatus becomes larger, and further, a framework to support the flywheel having such a large mass is necessary. Accordingly, a more complicated large mechanism to support the large weight is necessary.

On the other hand, in attempts of the optical scanning apparatus, since the technology proposed in Japanese Patent Publication Open to Public Inspection No. 15221/1984 has the aim to mechanically operate an optical path deflecting apparatus, it is difficult to quickly and accurately respond to uneven pitches of several μm, and further, the optical scanning apparatus itself can not entirely cope with vibrations which are generated in the apparatus main body or propagated from the outside of the apparatus. Further, since the technology disclosed in Japanese Patent Publication Open to Public Inspection No. 40398/1993 aims to deflect the optical path by an electric optical element, a high speed response can be realized. However, the optical scanning apparatus itself can not entirely cope with vibrations generated in the main body of the apparatus or propagated from the outside of the apparatus in the same way as the technology disclosed in the foregoing patent publication, and further, it can not cope with all vibrations relating to the root causes of the uneven pitches.

SUMMARY OF THE INVENTION

An object of the present invention is to provide a color image forming apparatus by which a high quality color image having no color registration failure, uneven pitch, and jittering can be obtained even in an image forming process in which load variations are inevitably caused, and further, to provide a light weighted and small sized image forming apparatus.

The first embodiment of a color image forming apparatus of the present invention comprises a rotating photoreceptor, a photoreceptor driving means for driving the photoreceptor, a speed detecting means for detecting speed information of the photoreceptor, and a mechanism in which a pressure-contact and pressure-contact release operations of a cleaning member are carried out on the photoreceptor. This first embodiment further comprises a drive control means by which the rotational speed of the photoreceptor is controlled according to a signal outputted from the speed detecting means so that the rotational speed of the photoreceptor remains equal to a predetermined value.

The second embodiment of the color image forming apparatus of the present invention actively controls the drive control means, and the detected number of frequencies of the speed detecting means is not less than 5 times the number of natural vibrations.

Further, the third embodiment of the color image forming apparatus of the present invention comprises a rotating photoreceptor, a photoreceptor driving means for driving the photoreceptor, a speed detecting means for detecting speed information of the photoreceptor, a mechanism for starting and stopping the drive of a developing unit, a mechanism in which pressure-contact and pressure-contact release operations of a transfer unit are carried out on the photoreceptor, and a mechanism in which pressure-contact and pressure-contact release operations of a cleaning member are carried out on the photoreceptor. This third embodiment further comprises a drive control means by which the rotational speed of the photoreceptor is controlled according to a signal outputted from the speed detecting means so that the rotational speed of the photoreceptor remains equal to a predetermined value.

In the present invention, a high quality image having no uneven pitch or jittering can be obtained, when speed variations due to a load on the photoreceptor is detected, a rotation driving means is actively controlled according to the speed variation data so that speed variations of the rotational body are eliminated, and thereby, a highly accurate electrostatic latent image is formed on the scanned surface.

That is, when rotational speed variations of the photoreceptor are caused by vibrations generated due to pressure-contact and its release of the cleaning means, and by start and stoppage of the drive of the developing unit and pressure-contact and its release operations of the transfer apparatus such as the transfer belt and the transfer roller conducted on the photoreceptor, the speed variation and its condition are calculated according to a signal obtained by the speed detecting means. Considering a time lag from the time of speed detection to the time of control according to the result of the calculation, the value of speed variation at the time of control is assumed from the condition of speed variation at the time of detection. When the driving source is controlled using the value of the speed variation, the polarity of which is reversed to that of the assumed value, as a value to be controlled in order to cancel the assumed variation, the rotational speed can be maintained to a predetermined value even when, the rotational speed of the photoreceptor tends to be unstable due to the vibration.

In the structure of the present invention, a speed detecting means for the rotating photoreceptor is provided as a basic element. Speed variation and its condition are calculated according to a signal obtained by the speed detecting means. The amount of speed variation at the time of control is assumed from the condition at the time of detection, considering a time lag from the time of speed detection to the time of control according to the result of the calculation. The driving source is actively controlled with respect to the assumed value, and the rotational speed of the photoreceptor is maintained to a predetermined value.

The active control in the present invention is carried out as follows. The value of speed variation is controlled to be zero when the value of speed variation, the polarity of which is reversed to that of the value of actual speed variation, is added to the value of actual speed variation. Strictly, however, the detection signal is calculated and the value to be controlled is computed during the period from the time of detection of speed variation to the time of actual control, and therefore, a time lag occurs. Accordingly, in the present invention, the condition of speed variation, namely, an increasing period of the speed variation, or a decreasing period of the speed variation is obtained by calculation, and the value of speed variation at the time of actual control is assumed. Then, the active control is carried out using the assumed value as the value to be controlled.

In the speed detecting means of the present invention, bar code lines having a predetermined distance between them are provided on the photoreceptor or the rotational shaft of the photoreceptor in order to detect the rotational speed. This bar code is optically detected as pulse signals and the speed is obtained from the pulse signals. As a specific example of this type speed detecting means, a rotary encoder is used.

A speed control system of the present invention is composed of a speed measuring system (behavior detection), a characteristic calculation system (response determination), and drive control system (drive pulse generation), and thereby, a driving means (driver unit) is drive-controlled.

The speed measuring system detects behavior of the photoreceptor. Noise components are removed, the speed is calculated, and the acceleration is calculated, according to the pulse signal obtained from the speed detecting means, and then, conditions of the photoreceptor are judged.

The characteristic calculation system determines the response speed. According to speed measuring data obtained by the speed measuring means, the value to be controlled is calculated in order to actively control the speed variation, and the response speed is determined.

The drive control system generates driving pulses and controls the drive of the photoreceptor. In this system, the value to be actively controlled, which is obtained by the characteristic calculation system, is converted into pulses to control the drive of the photoreceptor, and the pulses are generated.

As a circuit in the speed control system, a digital circuit or an analog circuit may be used. However, the digital circuit is preferable for the following reasons. In a digital circuit, pure data processing can be carried out, unnecessary signal variations, temperature variation, and dispersions of parts can be eliminated, and erroneous operations due to external factors can be prevented.

An application specific integrated circuit (hereinafter, called ASIC) and a digital signal processor (hereinafter, called DSP) can be used as the speed control system. However, it is preferable that the speed control system is structured by the ASIC because the time necessary for access and analysis of the programs and data can be eliminated and a high speed response can be carried out, and further, the structure of the IC chip can be simplified.

A pulse signal which is determined by the speed control system and outputted from the system, is received by the driver unit of the driving system, and the drive of the photoreceptor is controlled. As the driving means in the present invention, a motor is used. As the motor, a stepping motor, a DC motor, etc., can be used.

The stepping motor is preferable because it has excellent position controllability and responsibility, for example, it can be controlled by the pulse signal, so that it is easy to control, and it has no sliding portion, so that it has high reliability.

DETAILED DESCRIPTION OF THE PREFERRED EMBODIMENT

An example of a color image forming apparatus according to the present invention will be described below.

Figure 1:
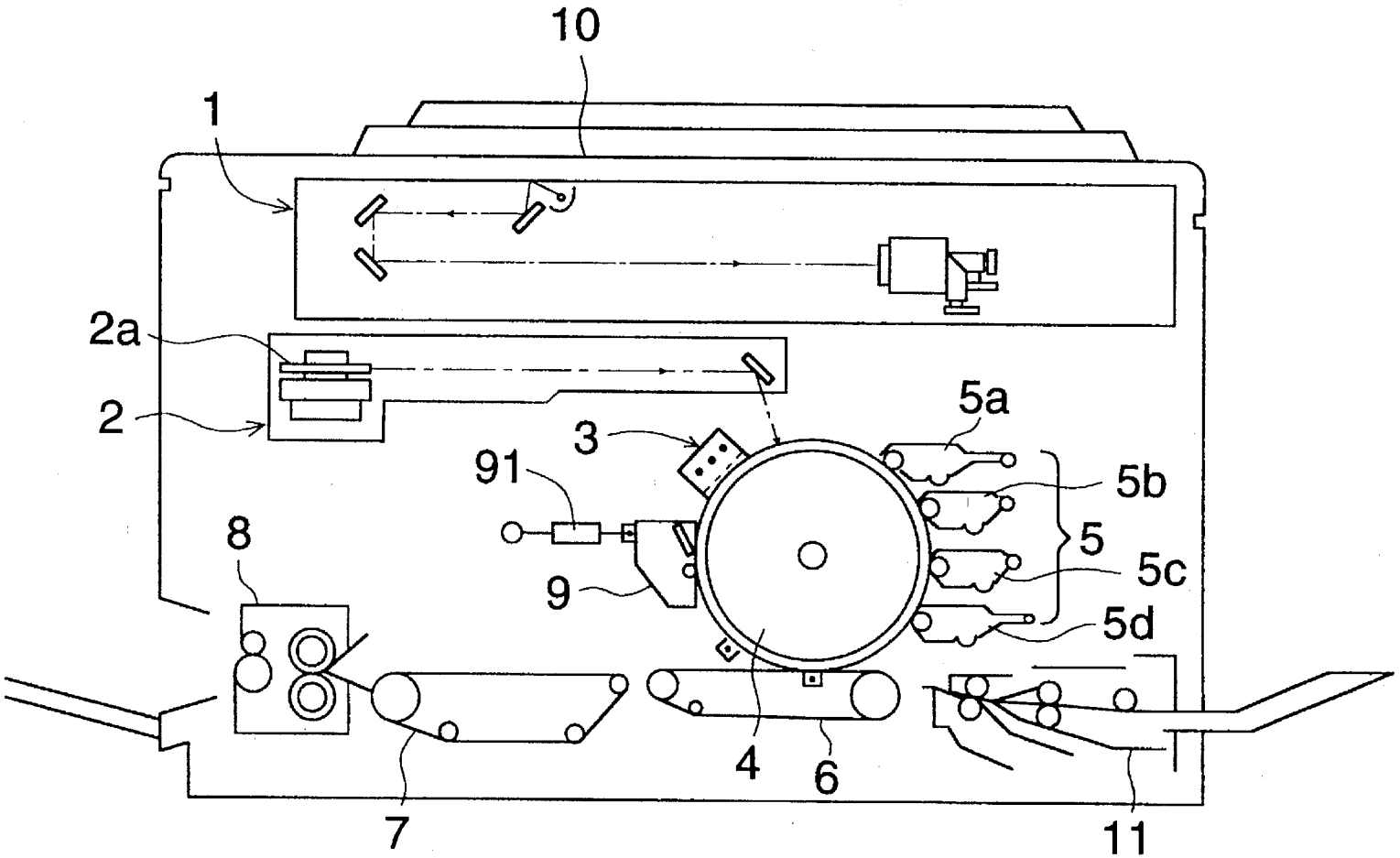
FIG. 1 is a sectional view of a color image forming apparatus according to the present invention.

FIG. 1 is a sectional view showing the entire structure of the color image forming apparatus.

In this color image forming apparatus, an image is read from a color document on a platen 10 in an image reading portion 1 and is converted into a digital signal. After that, laser beams corresponding to the first color signal outputted to an image writing portion 2, scan a photoreceptor 4, which is the surface to be scanned, and which has been previously uniformly charged by a charger 3. An electrostatic latent image corresponding to the first color is formed on the photoreceptor surface by a primary scanning by the laser beams and by a subsidiary scanning by rotation of the photoreceptor 4. This electrostatic latent image, thus formed, is developed by, for example, a developing unit 5*a* in which red toner is accommodated, and then a red toner image is formed on the photoreceptor surface. The toner image, thus obtained, passes under a cleaning means 9, which is separated and withdrawn from the photoreceptor surface, while the toner image is remaining on the photoreceptor surface, and then, the apparatus enters the next copy cycle.

The photoreceptor is recharged-uniformly by the charger 3. An electrostatic latent image corresponding to the second color outputted to the image writing portion 2 is formed on the photoreceptor surface when image writing onto the photoreceptor surface is carried out in the same way as in the first color signal. The latent image is developed by a developing unit 5*b* in which the second color, for example blue toner, is accommodated. This blue toner image is formed by being superimposed on the red toner image which has been previously formed on the photoreceptor.

The third color (for example, yellow) toner image, and the fourth color (for example, black) toner image are successively formed in the same way.

AC and DC bias voltages are impressed upon developing sleeves of developing units 5*a*, 5*b*, 5*c* and 5*d* which are used for color image formation of the present invention. Then, jumping development using a two-component developer is carried out and the image is noncontact-developed onto the grounded photoreceptor 4.

The thus formed toner images superimposed corresponding to the first through fourth color signals, are transferred onto a transfer body such as a recording sheet, in the transfer portion 6. After that, the transfer body is conveyed to a fixing unit 8 through a conveyance portion 7, and a fixed image is obtained. On the other hand, toners remaining on the photoreceptor which has passed through the transfer portion 6, are scraped off by a cleaning means 9, and then the photoreceptor is ready for the next image formation.

The cleaning means 9 is controlled by a pressure-contact/release means 91 into an operation condition in which the cleaning means is in pressure-contact with the photoreceptor 4, or an operation release condition in which the cleaning means is released from the photoreceptor 4.

In this connection, start and stoppage of the developing section 5, and pressure-contact with the photoreceptor 4 and pressure-contact release from the photoreceptor 4 are controlled by the control section (not shown in the drawings) of the entire image forming apparatus of the present invention.

Figure 2:
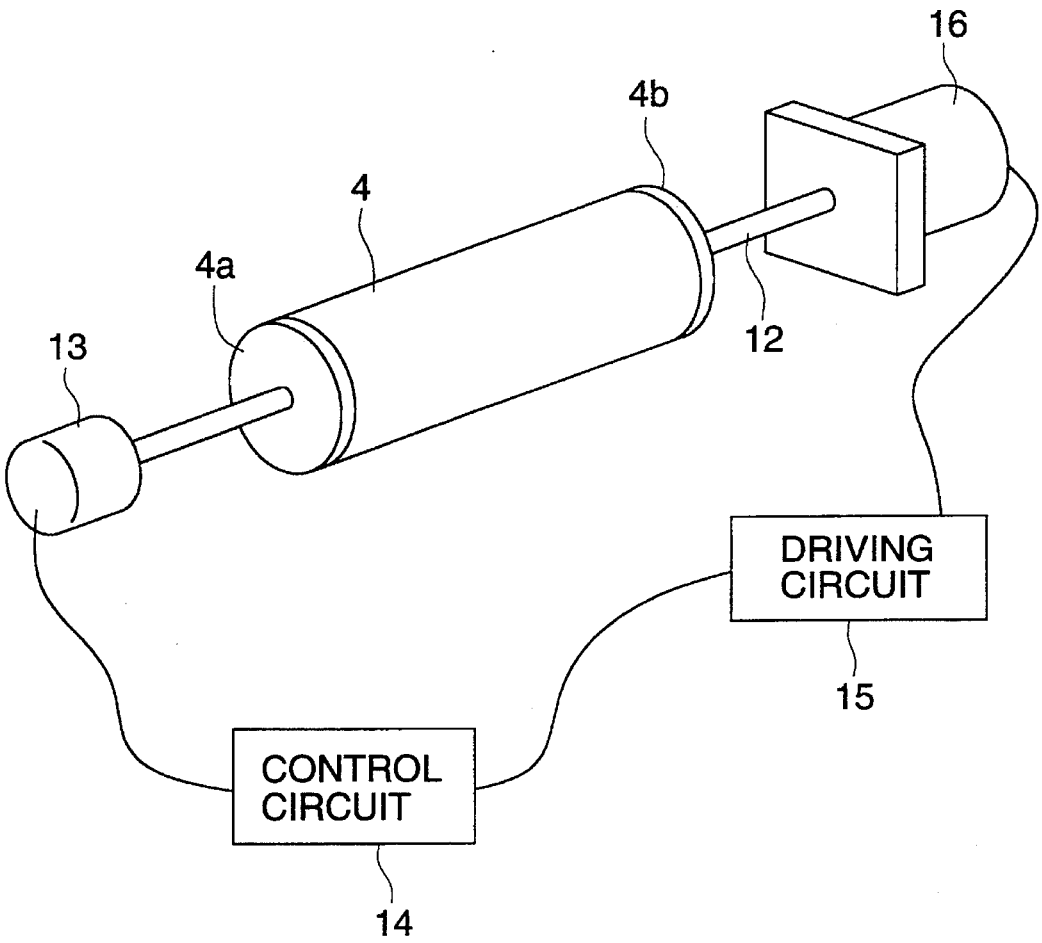
FIG. 2 is a conceptual view showing a drive control apparatus according to the present invention.

FIG. 2 is a conceptual view of a drive control apparatus housed in the color image forming apparatus in FIG. 1. Numeral 4 is the photoreceptor drum, 4*a* and 4*b* are flanges, 12 is a driving shaft, and the drive control apparatus is provided for this photoreceptor. In the drive control apparatus, numeral 13 is a speed detecting means, 14 is a control circuit, 15 is a drive circuit, and 16 is a driving means.

The photoreceptor drum 4 is cylindrical, and a supporting body of the photoreceptor drum is made of aluminum. An organic photosensitive layer, in which organic photosensitive compounds are dispersed in a binder, is provided on the surface of the photoreceptor drum 4. Flanges 4*a* and 4*b* are attached to both ends of photoreceptor drum 4, and the photoreceptor drum 4 is fixed to the driving shaft 12 through the flange 4*a*. In this example, only the flange 4*a* which is on the far side from the driving means 16, is fixed to the driving shaft 12, and the flange 4*b* is not fixed to the driving shaft 12. This is for the following reason. Vibrations due to torsion of the driving shaft 12 are determined by the distance between the driving apparatus and the fixed position. Accordingly, in order to reduce the frequency of the torsional vibration, it is preferable that this distance be prolonged as much as possible. Thereby, the frequency of the torsional vibration can be reduced. In this example, the characteristic frequency of the photoreceptor drum 4 caused by the torsional vibration is 10 Hz. Factors for determining the characteristic frequency of the photoreceptor drum are the mass of the load of the rotated photoreceptor drum and the like, and the rigidity of the driving shaft, etc., other than the above-described distance of the driving shaft. However, prolongation of the distance is more effective.

The driving means 16 is attached to one end of the driving shaft 12 to which the photoreceptor drum 4 is fixed, and the speed detecting means 13 is attached to the other end of the driving shaft.

The driving means is a stepping motor which generates 200 pulses per rotation. The rotation of the driving means 16 is controlled by driving pulses generated from the control circuit 15, and the driving shaft 12 is directly attached to the output shaft of the driving means 16. In order to prevent the vibrations which are factors in speed variations, it is preferable that the output shaft of the driving means is fixed directly to the driving shaft 12 as described in this example, however, the output shaft of the driving means may be connected to the driving shaft through a transmission mechanism, such as gears. In the stepping motor used in this example, the driving pulses correctly correspond to a driving rotational angle, and a driving pulse rate correctly corresponds to the rotational speed. Accordingly, the periodic control can be easily carried out by driving pulses, and this stepping motor is excellent in the correct position control.

The speed detecting means 13 is a rotary encoder having a resolving power of 9000 ppr (that is, 9000 pulses per rotation), outputs a pulse signal corresponding to the rotational speed of the driving shaft 12, and sends the pulse signal to the control circuit 14.

In the control circuit 14, the rotational speed of the driving shaft is calculated, the condition is judged, and the value to be active-controlled is determined, according to the pulse signal sent from the speed detecting means 13. Then, the value to be controlled is sent to the driving circuit 15.

The driving circuit 15 sends driving pulses to the driving means 16 so that the driving means 16 rotates the driving shaft 12 at the predetermined number of rotations. When speed variations occur, the driving pulse of the driving means is changed according to an active control signal, and the driving means is driven so as to be active-controlled. In this example, the ASIC is used in the control circuit 14 which is a digital circuit. In this control circuit, the control due to microcomputer software can also be used, and highly accurate speed control can be realized because the processing speed can be increased, and the response time is excellent.

In the active control in this example, the control is carried out by the exclusive use hardware, and the high speed response is maintained. Although control due to microcomputer software can also be adopted in this example, a longer period of time is necessary for program and data access, and analysis. When the system is controlled by the exclusive use hardware, the digital circuit is used and pure data processing is possible, and it is not necessary that changes of characteristics due to changes of temperature or dispersions of parts, etc., are considered. On the other hand, in an analog circuit, the circuit tends to be influenced by disturbances, and therefore, it is necessary to consider the maintenance of characteristic. In order to structure the circuit, the ASIC, which is inexpensive, and can be integrated into a single part, is used. When a DSP (digital signal processor) is used, a plurality of chips are necessary, and the cost is higher.

Figure 3:
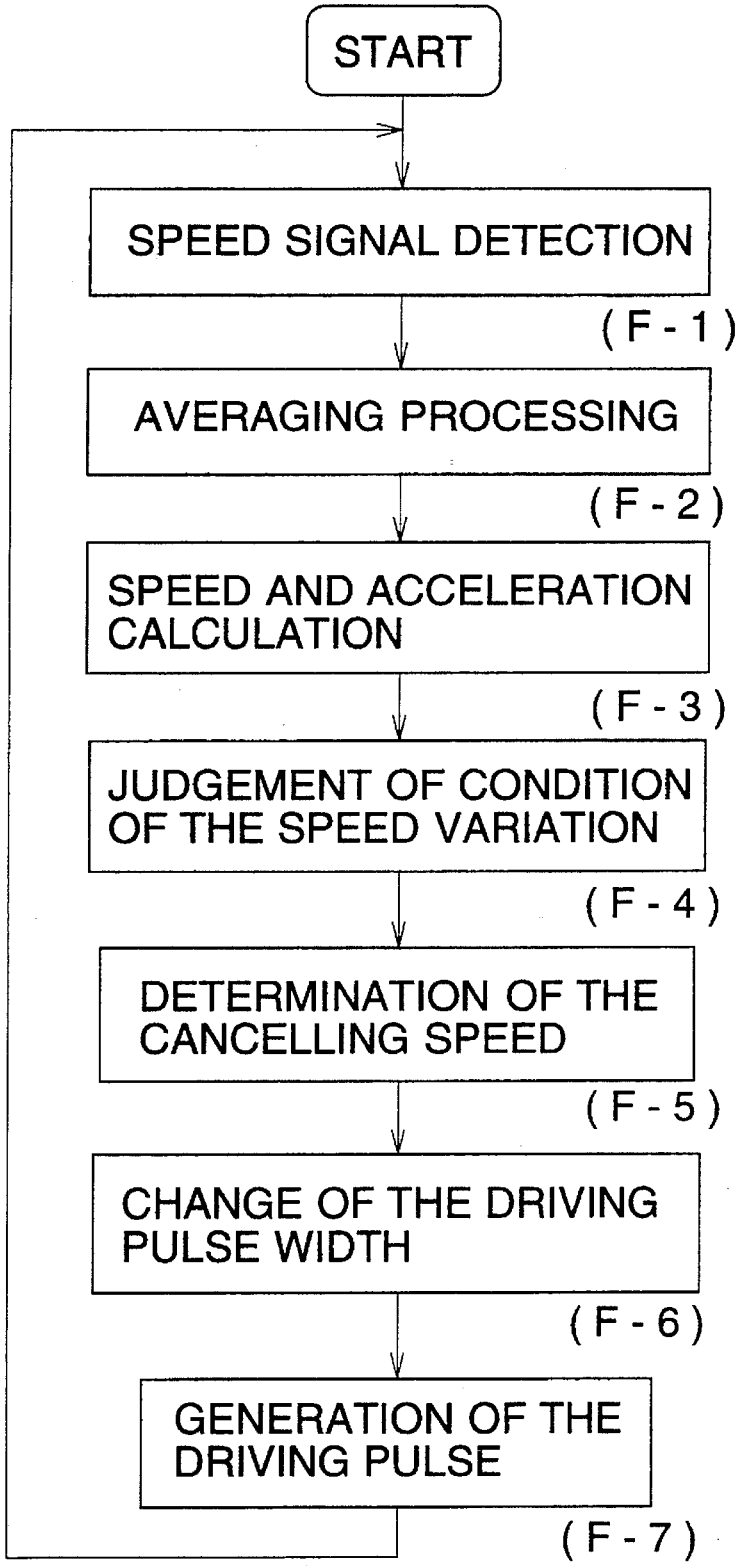
FIG. 3 is a flow chart showing photoreceptor drive control processing according to the present invention.

In FIG. 3, a flow chart of the rotational control of this example is shown. The number of rotations of the driving shaft 12 detected by the speed detecting means 13 is sent to the control circuit 14 in the form of the pulse signal as described above. In the control circuit 14, the detected pulse signal sent from the speed detecting means 13 is detected (F-1), the signal data is average-processed and noise components are removed (F-2), and the rotational speed and the acceleration are calculated from the averaged signal (F-3). Next, the existence of any variation is judged. When it is judged that a variation exists, it is judged in which condition from the start of the variation to the end of variation the current condition of the speed variation positions (F-4). According to the judged result of the condition of the speed variation, a cancelling speed to cancel the generating variation is calculated (F-5). The cancelling speed data is converted into a drive control pulse to control the drive of the driving means 16 in the driving circuit 15 (F-6), and the drive control pulse (F-7) is sent to the driving means 16 for drive control.

Next, referring to FIGS. 4(*a*) through 4(*e*), detail of the flow chart will be explained.

Figure 4:
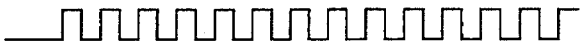
FIGS. 4(*a*) through 4(*e*) are graphs showing averaging processing.
Figure 4:
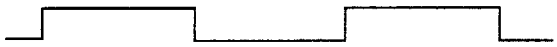
Figure 4:
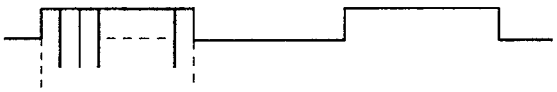
Figure 4:
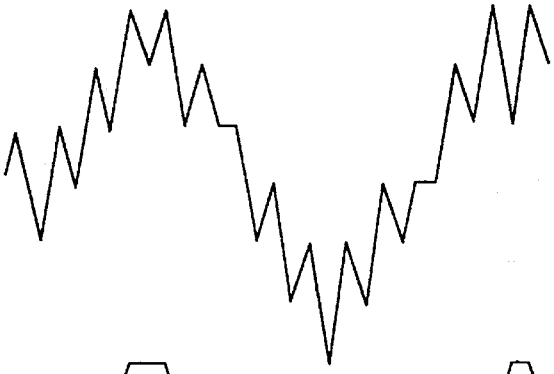
Figure 4:
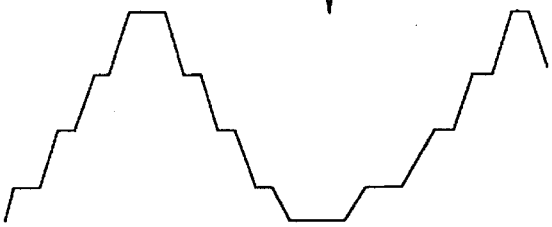

In an averaging processing process F-2, the waveform of the pulse signal, shown in FIG. 4(*a*), obtained from the speed detecting means 13 is ⅛ frequency-multiplied. The ⅛ frequency-multiplied waveform is measured by detecting frequencies of 6 MHz as shown in FIG. 4(*c*). The value obtained by this measurement, is the time for the unit rotation angle. The rotational speed is calculated from the above value, and is converted into its numerical value. Then, the rotational speed signal is obtained as shown in FIG. 4(*d*). When this rotational signal passes through a low-pass filter and is averaging processed as shown in FIG. 4(*e*), noise components are removed, and the thus processed signal can be a signal appropriate for the rotation control. When this averaging processing is not conducted, the component of variation to be controlled is greatly affected by noise components, and therefore, appropriate rotational speed control can not be carried out.

Figure 5:
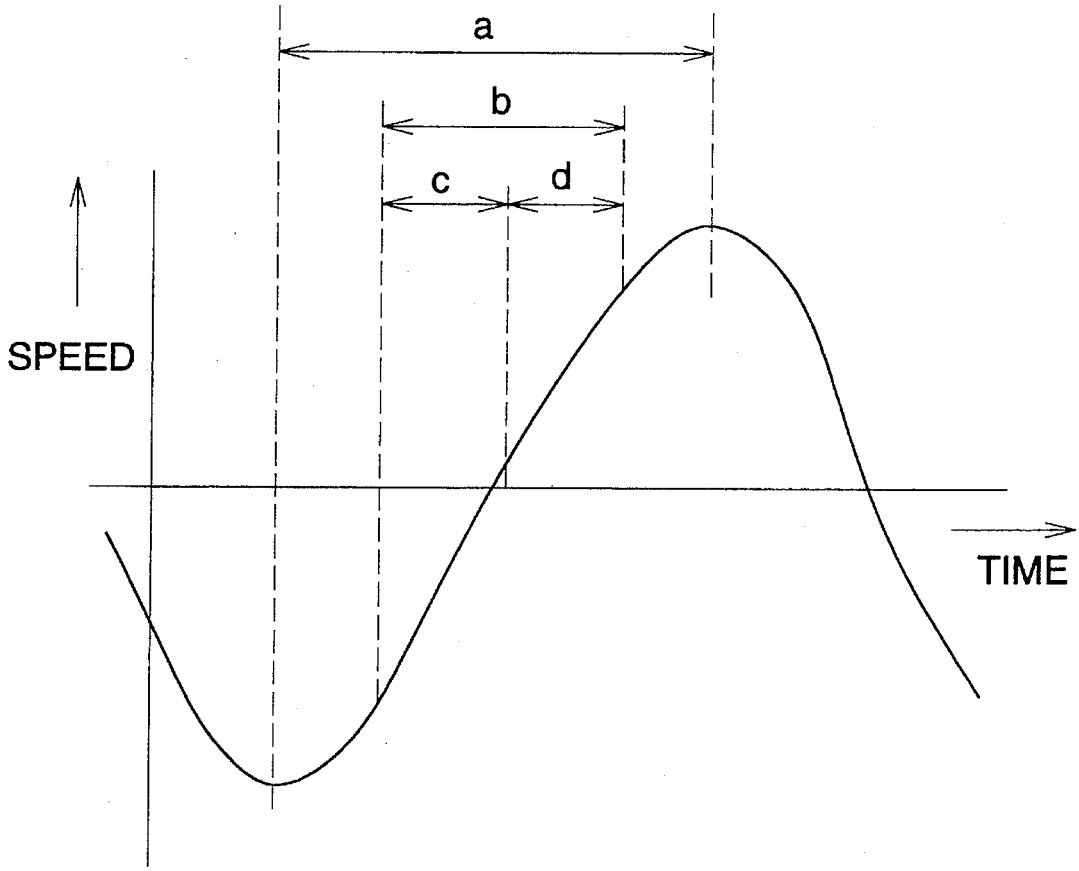
FIG. 5 is a graph showing speed variations.

The speed variation condition judgement process (F-4), and the cancelling speed determination process (F-5) will be described using FIG. 5 below. In a graph shown in FIG. 5, the horizontal axis shows time, and the rotational speed of the rotational body is plotted in the direction of the vertical axis. When the cancelling speed is determined, in the speed variation condition judgement process (F-4), for example, in order to judge the condition of the "a"-portion during which the speed is increasing, the current speed is compared with the previous speed data. When the current speed is higher than the previous speed, it is judged that the speed is on the increasing condition. Further, the condition of speed variation is judged from acceleration data, and the increasing inclination of the speed variation is also judged. According to the judgement result of the condition of the speed variation, in the next cancelling speed determination process (F-5), the cancelling speed is determined considering the condition of the speed variation, without simply using the reversed value to the detected speed variation as the cancelling speed. In the present invention, it is preferable that a detecting frequency of the speed detecting means is not less than 5 times a characteristic frequency of the rotational body in order to increase the response, and it is more preferable when it is not less than 10 times.

Figure 6:
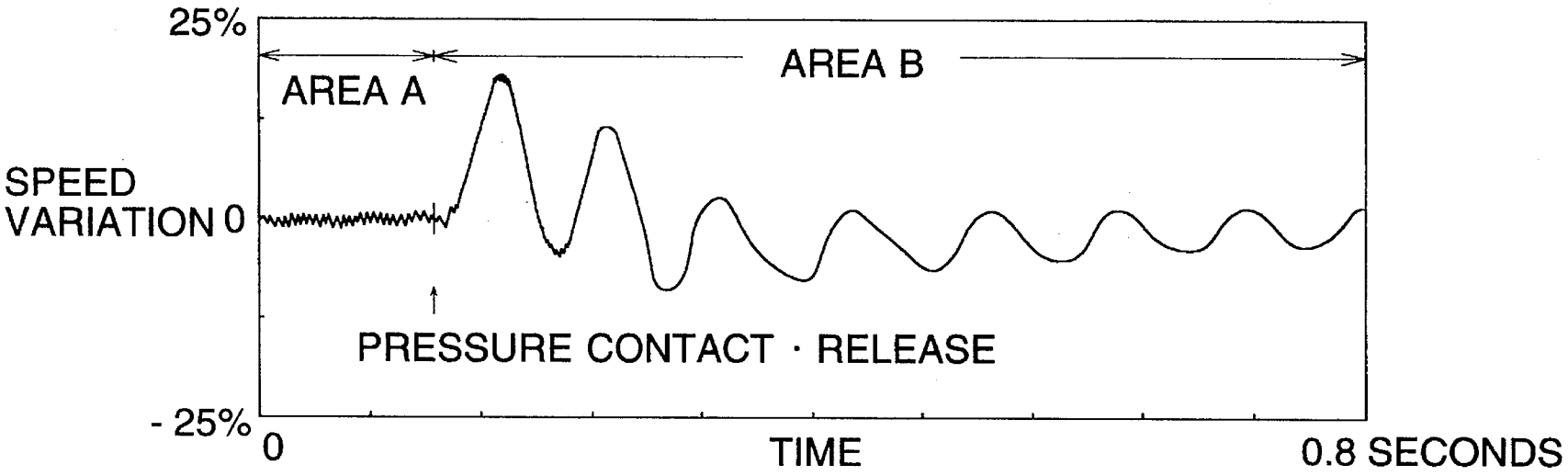
FIG. 6 is an example of data of the waveform showing a speed variation control in the conventional technology.
Figure 7:
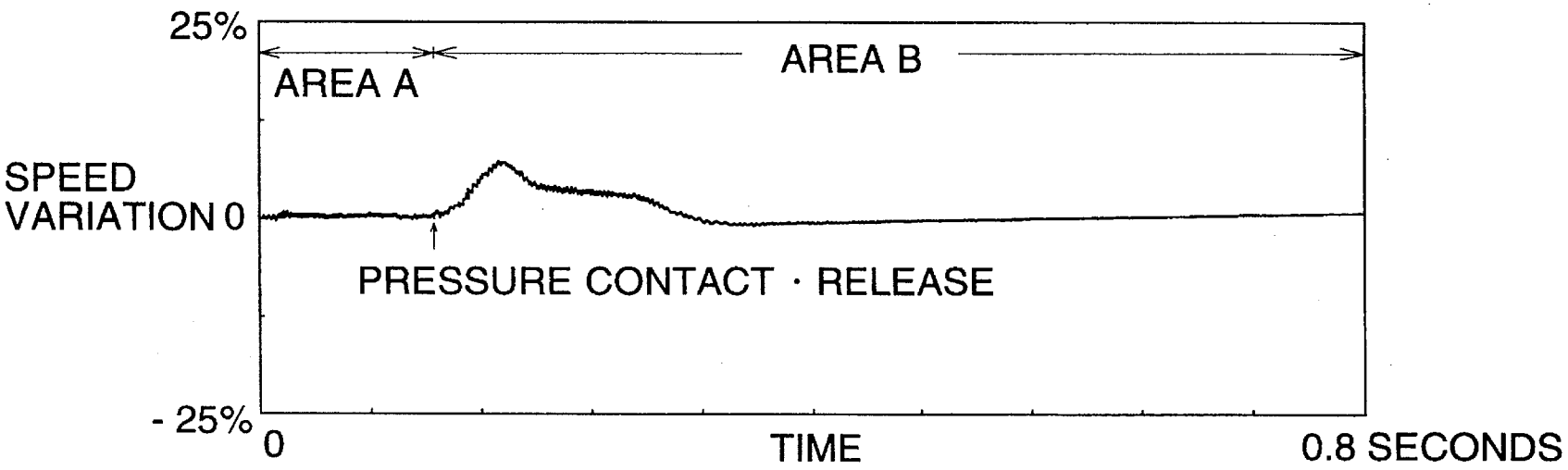
FIG. 7 is an example of data of the waveform showing a speed variation control in this example.

An example of data of the waveform showing the result of control of the speed variation is shown in FIG. 7. Area A in FIG. 7 shows the condition of normal steady state variation. Area B shows the condition of variation after the pressure-contact/release. FIG. 6 shows an example of data of the waveform in the conventional technology in which no control is conducted, and FIG. 7 shows an example in which speed variation control is conducted. As understood from FIG. 7, in the present invention, the variation is rapidly eliminated in area B after the pressure-contact/release, and the control is satisfactorily carried out. In contrast to this, in FIG. 6 which is an example of data of the waveform in the conventional technology, the variation continues for some time after the pressure-contact/release in area B.

As described above, according to the drive control apparatus in this example, the rotation speed of the photoreceptor drum 4, which is rotated by the driving means 16, is always very accurately detected by the speed detecting means 13, and detected signal data is successively sent to the control circuit 14. When the rotational speed variation of the photoreceptor drum 4 is generated, it is immediately analyzed, and the cancelling speed is calculated so that the variation is cancelled. For example, when the speed is increasing, the rotational speed is controlled to decrease. When the driving means 16 is controlled with this cancelling speed, the variation is eliminated and the rotation speed of the photoreceptor drum 4 can be maintained constant.

According to the present invention, in also a color image forming apparatus in which load variation is inevitably caused, the apparatus comprises a driving means for driving the rotation of the photoreceptor, a speed detecting means for detecting rotational speed information of the photoreceptor, and a control means for calculating a cancelling speed, which actively cancels the speed variation, from the detected speed variation, and for controlling the driving means of the photoreceptor with the cancelling speed obtained by the calculation. Therefore, when the rotational speed variation of the photoreceptor occurs due to load variation, a change of the speed to cancel the variation is applied to the driving apparatus. Accordingly, the speed variation can be controlled, and the driving apparatus can be rotated at a predetermined rotational speed. Accordingly the photoreceptor drum can be rotated at a predetermined rotational speed without any variation, and a high quality color image with no color registration failure, no uneven pitch and no jittering can be obtained in the color image formation.

Further, it is not necessary to use a flywheel in the apparatus. Accordingly, a simpler and more compact color image forming apparatus which is smaller and lighter, can be realized.

What is claimed is:

1. A color image forming apparatus comprising:

(a) a rotational photoreceptor for forming an image thereon;

(b) drive means for driving the photoreceptor to rotate;

(c) a speed detector for detecting a rotational speed of the photoreceptor, the speed detector being provided on an opposite side of the photoreceptor with respect to the drive means;

(d) a cleaning member for cleaning a residual toner on the photoreceptor;

(e) a mechanism for bringing the cleaning member into pressure contact with the photoreceptor and for releasing the cleaning member from the photoreceptor; and (f) a drive controller for controlling the rotational speed of the photoreceptor in accordance with a signal from the speed detector so as to be a preset value.

2. The apparatus of claim 1, wherein the drive controller includes means for controlling the drive means to eliminate rotational speed variations of the photoreceptor.

3. The apparatus of claim 1, wherein a detecting frequency of the speed detector is not less than 5 times a characteristic frequency of the photoreceptor.

4. A color image forming apparatus comprising:

(a) a rotational photoreceptor for forming an image thereon, the photoreceptor having a flange attached to one end thereof;

(b) drive means for driving a drive shaft fixed to the photoreceptor at said flange, said drive shaft extending through the photoreceptor from said flange to said drive means;

(c) a speed detector for detecting a rotational speed of the photoreceptor at the flange;

(d) a cleaning member for cleaning a residual toner on the photoreceptor;

(e) a mechanism for bringing the cleaning member into pressure contact with the photoreceptor and for releasing the cleaning member from the photoreceptor; and (f) a drive controller for controlling the rotational speed of the photoreceptor in accordance with a signal from the speed detector so as to be a preset value.

5. The apparatus of claim 4, wherein the drive controller includes means for controlling the drive means to eliminate rotational speed variations of the photoreceptor.

6. The apparatus of claim 4, wherein a detecting frequency of the speed detector is not less than 5 times a characteristic frequency of the photoreceptor.

7. A color image forming apparatus comprising:

(a) a rotational photoreceptor for forming an image thereon, the photoreceptor having a flange attached to one end thereof;

(b) drive means for driving a drive shaft fixed to the photoreceptor at said flange;

(c) a speed detector for detecting a rotational speed of the photoreceptor at said flange;

(d) a cleaning member for cleaning a residual toner on the photoreceptor;

(e) a mechanism for bringing the cleaning member into pressure contact with the photoreceptor and for releasing the cleaning member from the photoreceptor; and (f) a drive controller for controlling the rotational speed of the photoreceptor in accordance with a signal from the speed detector so as to be a preset value.

8. The apparatus of claim 7, wherein the drive controller includes means for controlling the drive means to eliminate rotational speed variations of the photoreceptor.

9. The apparatus of claim 7, wherein a detecting frequency of the speed detector is not less than 5 times a characteristic frequency of the photoreceptor.

* * * * *